US005778760A

United States Patent [19]

Yuda

[11] Patent Number: 5,778,760

[45] Date of Patent: Jul. 14, 1998

[54] END CAP FOR INTERMEDIATE USE IN CYLINDER ASSEMBLY AND METHOD

[76] Inventor: Lawrence F. Yuda, 105 Meadowcrest Dr., Seneca, S.C. 29678

[21] Appl. No.: 838,282

[22] Filed: Apr. 16, 1997

[51] Int. Cl.[6] ..... F01B 7/00

[52] U.S. Cl. ..... 92/151; 92/128; 92/166

[58] Field of Search ..... 92/61, 62, 128, 92/150, 151, 152, 166

[56] References Cited

U.S. PATENT DOCUMENTS 2,085,105 6/1937 Lex ..... 92/151

3,457,841 7/1969 Tregaskiss ..... 92/151

4,685,384 8/1987 Dirkin et al. ..... 92/166

*Primary Examiner*—Thomas E. Denion

*Attorney, Agent, or Firm*—Ralph Bailey

[57] ABSTRACT

A multiple piston and cylinder assembly is illustrated utilizing first and second transversely bifurcated segments (A) and (B) for retention by an intermediate snap ring (D) installed within a single groove (C) facilitating a sealing abutting relation between the segments utilizing a sealing and retaining member (E) wherein the segments are inserted from opposite ends of the cylinder.

7 Claims, 2 Drawing Sheets

END CAP FOR INTERMEDIATE USE IN CYLINDER ASSEMBLY AND METHOD

BACKGROUND OF THE INVENTION

This invention relates to multi piston assemblies and, more particularly, to a cylinder having an improved intermediate end cap for dividing the cylinder bore into chambers and method of securement utilizing a single groove to retain the end cap within the cylinder wall.

The force output of fluid powered linear actuators can be increased by stacking individual pistons on a common rod as illustrated in U.S. Pat. No. 5,522,302. Each of these pistons is placed in a separate sealed chamber within a cylinder into which fluid under pressure is introduced so that the net actuator output is the sum of individual outputs generated in each chamber. Typically, such actuators are made from a common bore into which intermediate end caps are placed to form separate chambers. One of the common methods used to form these chambers is to retain an end cap between two snap rings held in matching grooves on the frame. While simple and effective, the required assembly process gets very difficult, especially when deep grooves are required. The present invention contemplates using a single groove to retain the intermediate end cap and lends itself to much easier assembly.

SUMMARY OF THE INVENTION

Accordingly, it is an important object of this invention to provide an improved intermediate end cap wherein a single groove may be machined for utilizing a retaining member such as a metallic snap ring for securement of the end cap within a cylinder wall for dividing a cylinder into separate chambers.

Another important object of the invention is to facilitate construction and assembly of the cylinder and associated parts avoiding the necessity for machining closely toleranced grooves in the bore by the use of a single fastener facilitating easier assembly.

While the cylinder and end cap construction is illustrated in the context of a tandem cylinder, a number of such improved end caps may be utilized to facilitate additional constructions involving multiple piston assemblies of any reasonably desired number and the invention is not limited in respect to the number of chambers and pistons or cylinder frame members utilized therewith.

The intermediate end cap cylinder is constructed in two concentric sections with a snap ring between them. Thus, the end cap is preferably bifurcated embodying two transverse substantially cylindrical sections. A single groove is machined into the bore and a snap ring placed in it. Then sections of the end cap are inserted from opposite ends of the cylinder to abut the snap ring. These sections are then held together using another snap ring or O-ring. Another suitable fastener may include holding the two sections together using Compact Air Products, Inc's. patented Snap Cap fastener and method illustrated in U.S. Pat. Nos. 4,924,758, 5,070,767, and 5,117,743. The only load bearing fastener member in this assembly is the central snap ring holding the end cap in relation to the bore. The fastener used to retain the end cap sections to each other is not subject to load.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
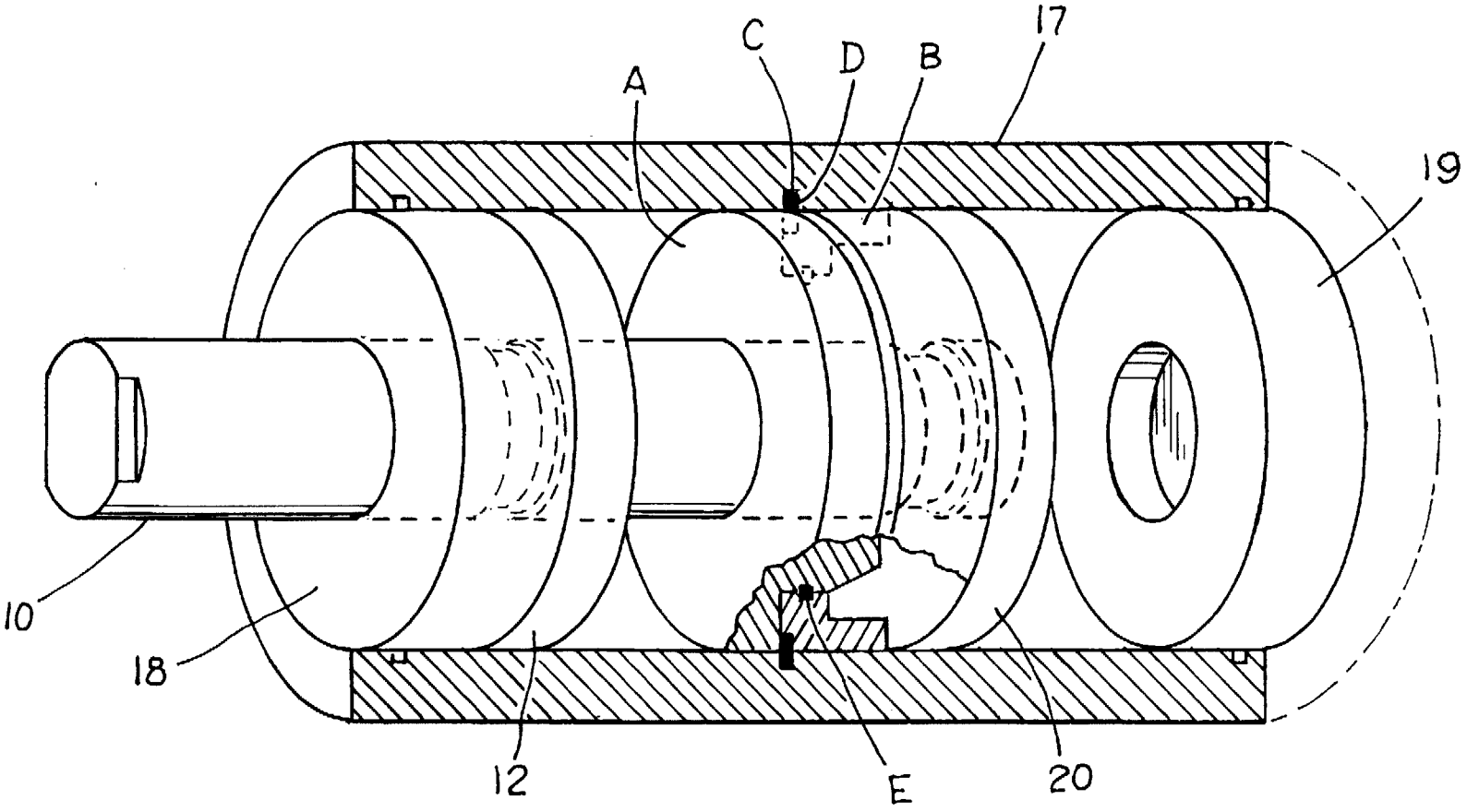
FIG. 1 is a perspective view schematically illustrating a tandem cylinder including a bifurcated end cap assembled in accordance with the present invention.

The drawings illustrate an end cap for forming separate chambers within a cylinder wall and for slidably receiving a piston rod carrying a piston in each chamber. A first circular segment A has a substantially continuous peripheral surface adjacent the cylinder wall. A second circular segment B is disposed in concentric abutting relation to the first segment and has a substantially continuous peripheral surface adjacent the cylinder wall. A single groove C is machined in the cylinder wall between the first and second segments for receiving a retaining member. A retaining member D is carried in the groove between the first and second segments. A fastening member E connects the first and second segments. Thus, a single groove in the cylinder wall may receive a retaining member such as a metallic snap ring for restraining and positioning the end cap within the cylinder wall.

A double piston shaft assembly includes a piston shaft 10 having a groove 11 for retaining a first piston 12. The piston 12 is illustrated as having suitable securement means 13 as well as sealing means 14 for attachment within the groove 11. An o-ring 15 is provided for sealing the piston within the bore 16 of the cylinder 17. The cylinder is provided with a conventional end cap 18 on one end for accommodating the piston rod 10 and a blank end cap 19 on the other end of the bore 16. A second piston 20 is illustrated as being suitably secured within a second groove 21 adjacent an inner end of the piston rod 10 employing suitable securement and sealing devices as described above in connection with the first piston 12. The end cap has a first segment A having a bore 22 for accommodating the piston rod 10 and is provided with an O-ring 23 arranged in sealing relation with the bore 16 dividing the cylinder wall. The first segment A has a forwardly extending boss 24 for receiving the second segment B which also has a concentric bore and which is suitably fastened by a fastening member E as described above.

Figure 2:
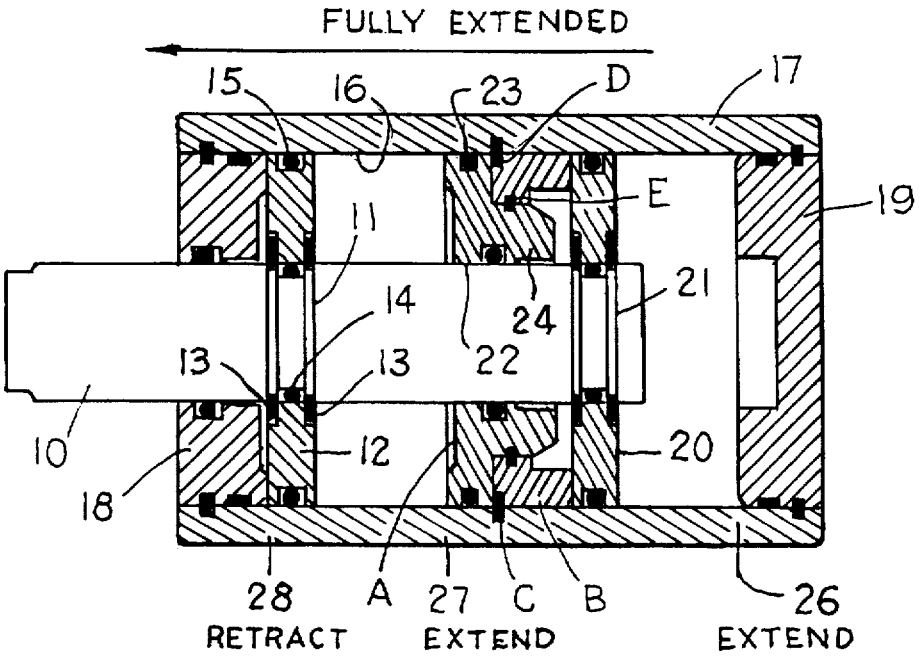
FIG. 2 is a longitudinal sectional elevation further illustrating the cylinder assembly of FIG. 1 with the parts in fully extended position.
Figure 3:
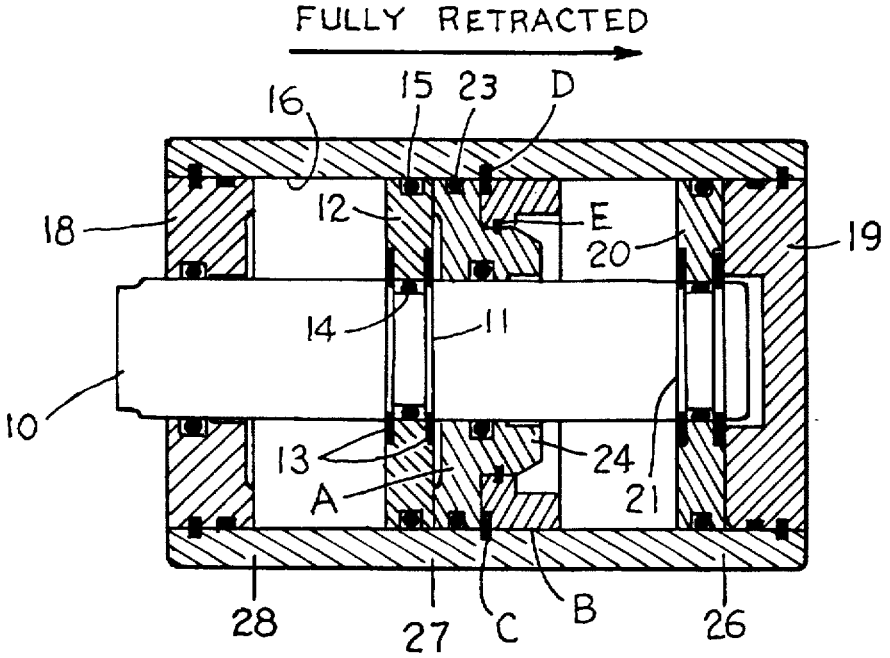
FIG. 3 is a schematic longitudinal sectional elevation illustrating the parts in fully retracted position.

FIGS. 2 and 3 schematically illustrate suitable ports 26 and 27 for supplying pressurized fluid from a suitable source such as an air pump (not shown) for extending the piston assembly as well as port 28 for retracting the piston assembly.

It will be noted that the snap ring and groove receive forces in both directions as distinguished from a conventional construction using two grooves. The fastening member E does not resist any substantial load in either direction but preferably acts as a sealing member.

The method of construction and assembly contemplate first machining the groove C for receiving and positioning the metallic snap ring D. After the snap ring is inserted the first segment A is inserted from a first end of the cylinder and then the second segment B is inserted from the other end of the cylinder. A double piston shaft assembly, including the piston rod 10, is inserted together with a first piston 12. Thereafter, the second piston 20 is inserted from the other end of the cylinder and secured within the groove 21. The blank end cap 19 is then installed to complete the assembly.

It is thus seen that a multiple piston and cylinder arrangement may be provided utilizing a single machined groove for fastening respective intermediate end caps for subdividing the cylinder bore into multiple chambers. The steps utilized in manufacture and assembly are considerably simplified because of the use of the single groove accommodated between the bifurcated segments forming each intermediate end cap.

While a preferred embodiment of the invention has been described using specific terms, such description is for illustrative purposes only, and it is to be understood that changes and variations may be made without departing from the spirit or scope of the following claims.

What is claimed is:

1. An end cap for forming separate chambers within a cylinder wall and for slidably receiving a piston rod carrying a piston in each chamber comprising:

a first circular segment having a substantially continuous peripheral surface adjacent the cylinder wall;

a second circular segment in concentric abutting relation to said first segment and having a substantially continuous peripheral surface opposite and adjacent said cylinder wall;

a single groove in said cylinder wall between said first and second segments for receiving a retaining member;

a retaining member carried in said groove between said first and second segments; and a fastening member connecting said first and second segments;

whereby a single groove in the cylinder wall receives a retaining member restraining and positioning said end cap within said cylinder wall.

2. The end cap set forth in claim 1 wherein said groove carries said retaining member in abutting relation with said first and second segments.

3. The end cap set forth in claim 2 wherein said retaining member is a snap ring.

4. The end cap set forth in claim 1 wherein said first segment extends through a bore in said second segment, and wherein said fastening member includes an O-ring.

5. A method of mounting an end cap within a cylinder wall between spaced pistons comprising the steps of:

providing a first circular segment having a substantially continuous peripheral surface for positioning within said cylinder wall;

providing a second circular segment for positioning in concentric relation adjacent said first segment and having a substantially continuous peripheral surface adjacent said cylinder wall;

machining a single groove in said cylinder wall;

inserting a retaining member in said groove;

positioning said first and second segments on respective sides of said retaining member; and a securing fastening member between said first and second segments;

whereby a single groove in the cylinder wall receives a retaining member restraining and positioning said end cap within said cylinder wall.

6. The method set forth in claim 4 including the step of:

providing a metallic snap ring for insertion within said groove.

7. The method set forth in claim 4 including the step of:

providing a flexible member in sealing relation between said first and second segments.

* * * * *